US006488163B1

(12) United States Patent
Wurzer et al.

(10) Patent No.: US 6,488,163 B1
(45) Date of Patent: Dec. 3, 2002

(54) KNUCKLE COUPLER PIN

(75) Inventors: Jeffrey D. Wurzer, Turtle Creek, PA (US); Joseph L. Gagliardino, Oakdale, PA (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/410,589

(22) Filed: Oct. 1, 1999

(51) Int. Cl.[7] ..... B61G 7/00
(52) U.S. Cl. ..... 213/155; 213/127
(58) Field of Search ..... 213/127, 115, 213/125, 118, 155, 156; 474/228; 384/276, 296; 411/513, 351, 520; 74/403

(56) References Cited

U.S. PATENT DOCUMENTS

| | | | | | |
|---|---|---|---|---|---|
| 478,446 | A | * | 7/1892 | Ludlow | 213/125 |
| 503,910 | A | * | 8/1893 | Merry | 384/296 |
| 1,089,396 | A | * | 3/1914 | Coleman | 213/127 |
| 3,675,787 | A | * | 7/1972 | Krauskopf | 213/153 |
| 3,857,495 | A | * | 12/1974 | Kaufhold | 213/151 |
| 4,267,935 | A | * | 5/1981 | Dilg | 213/72 |
| 4,422,711 | A | * | 12/1983 | Wolowicz | 339/252 R |
| 4,466,763 | A | * | 8/1984 | Fischer | 114/352 |
| 4,502,818 | A | * | 3/1985 | Elders | 405/259.3 |
| 5,145,025 | A | | 9/1992 | Damian | 180/381 |
| 5,145,076 | A | * | 9/1992 | Murphy et al. | 213/155 |
| 5,174,680 | A | * | 12/1992 | Nakamura et al. | 301/111.01 |
| 5,285,911 | A | | 2/1994 | Altherr | 213/152 |
| 5,601,370 | A | * | 2/1997 | Shibayama et al. | 384/215 |
| 5,630,519 | A | | 5/1997 | Burke et al. | 213/155 |
| 5,704,752 | A | * | 1/1998 | Logerot | 403/248 |
| 5,736,088 | A | | 4/1998 | Burke et al. | 264/237 |
| 5,899,647 | A | * | 5/1999 | Gschwend et al. | 411/29 |
| 6,004,237 | A | * | 12/1999 | Lodico et al. | 474/138 |

OTHER PUBLICATIONS

Specification M–118–61, "Coupler Knuckle Pivot Pins and Swivel Pins for Swivel Shank Coupler", Association of American Railroads, Mechanical Division, Manual of Standards and Recommended Practices, pp. B–143/B–145, Adopted: 1917, Revised: 1961.

Specification M–118–91, "Coupler Knuckle Pivot Pins and Coupler Shank Connecting Pins", Association of American Railroads, Mechanical Division, Manual of Standards and Recommended Practices, pp. B–1/B–3, Adopted: 1917, Revised: 1991.

Presentation: C–10 Pin Breakage, 14 pages. Mechanical Committee of Standard Coupler Manufacturers ("MCSCM")/American Rail Car Institute ("ARCI") and Association of American Railroads ("AAR") Meeting. The MCSCM met with the Wheels, Axles, Bearings and Lubrication Working ("WABL") Committee of the AAR, Held Jun., 1997.

McConway & Torley Corporation, "The M&T Straight Pin Hole Coupler Knuckle", McConway & Torley Corporation, 4 pages, Jan. 9, 1989.

* cited by examiner

*Primary Examiner*—S. Joseph Morano
*Assistant Examiner*—Frantz F. Jules
(74) *Attorney, Agent, or Firm*—Baker Botts L.L.P.

(57) ABSTRACT

A railroad car (18) uses a coupling system (10) to couple to other railroad cars. The coupling system includes a coupler (12), a knuckle (14), a knuckle pin (16) and a lock (30). When two railroad cars are coupled to each other, the knuckles of the two railroad cars are engaged and the forces produced during buff and draft movement of the railroad cars are transmitted through the knuckles, the coupler and the locks. Under normal operation, the knuckle pin should experience minimal forces during the buff and draft movement of the railroad cars. However, over time the various components that make up the coupler system may fall out of tolerance due to usage, wear and other factors. As the various components of the coupler system fall out of tolerance, increasing bending forces are applied to the knuckle pin. A knuckle pin with a slot (52) and a hollow body (50) is capable of withstanding bending forces applied to the knuckle pin by out-of-tolerance coupling systems.

48 Claims, 4 Drawing Sheets

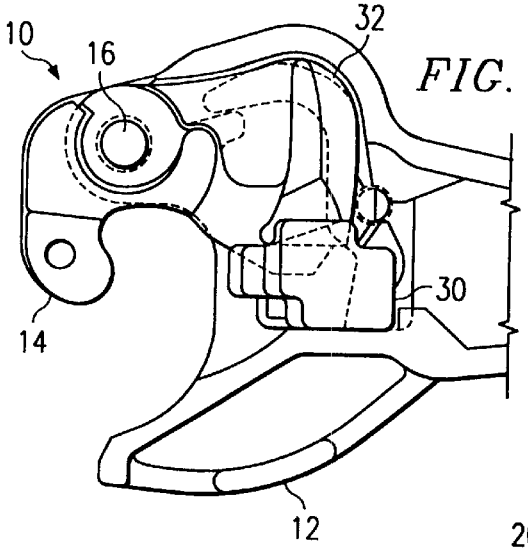
FIG. 2
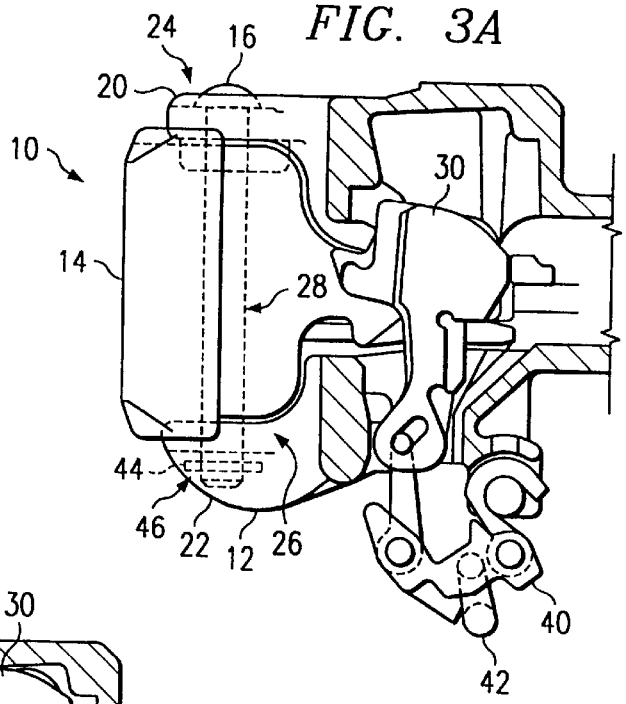
FIG. 3A
FIG. 3B
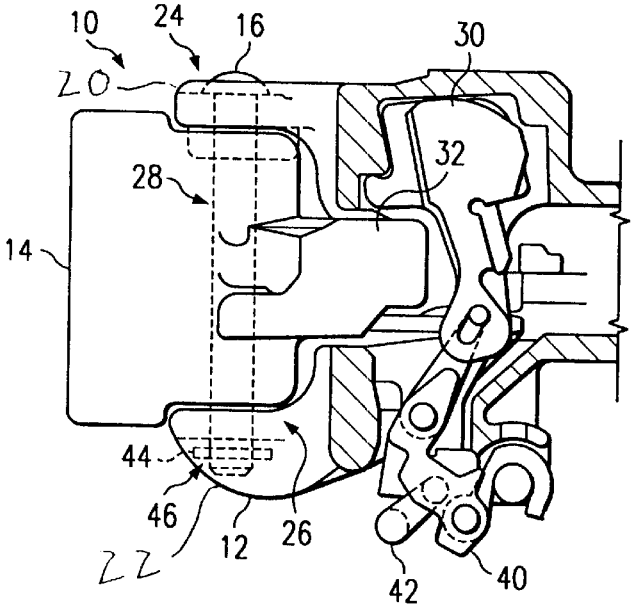

FIG. 4
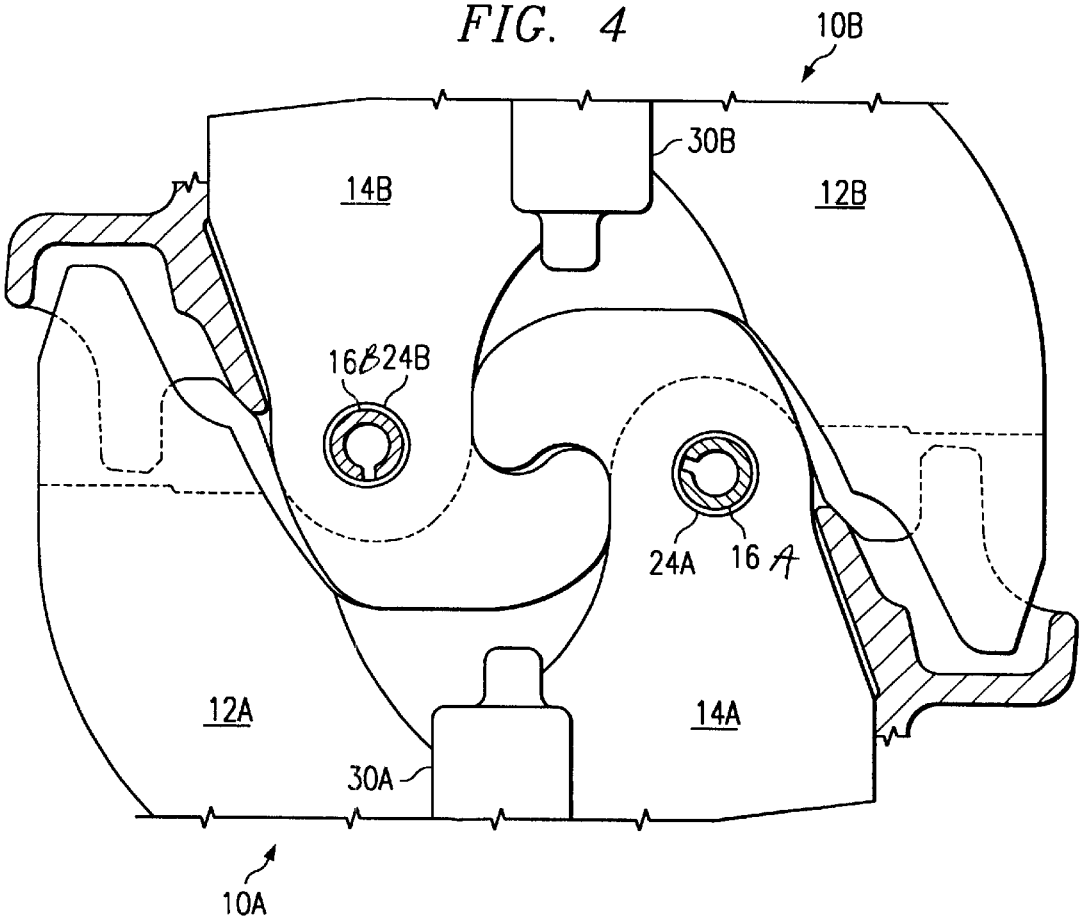
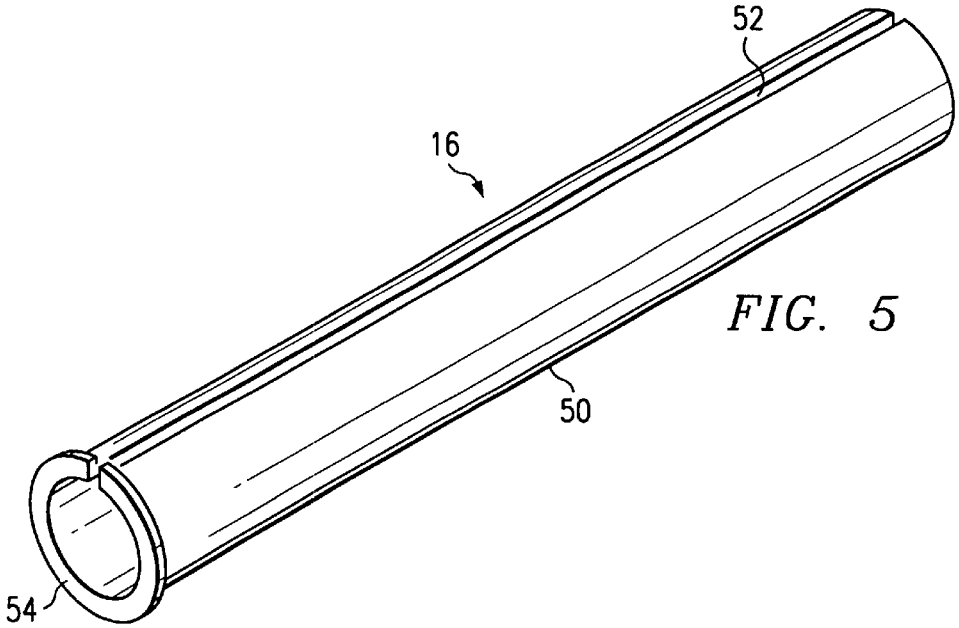
FIG. 5

KNUCKLE COUPLER PIN

TECHNICAL FIELD OF THE INVENTION

This invention relates in general to railroad car coupling systems and, more particularly, to a system and apparatus for a knuckle coupler pin for railroad car coupling systems.

BACKGROUND OF THE INVENTION

Railroad cars use couplers to attach one railroad car to another. Currently, many railroad car couplers use knuckle couplers that engage with each other to couple the railroad cars together. The operation of the knuckle requires that the knuckle be able to pivot around a knuckle pin. Traditional knuckle pins have been of a generally cylindrical shape and have been formed as solid pieces using various types of materials. Railroad car couplers are designed to meet various tolerances in order to control the distribution of force upon the couplers during buff and draft movement of the railroad cars.

SUMMARY OF THE INVENTION

As use takes its toll on couplers, couplers begin to fall out of tolerance and the distribution of force changes. In particular, knuckle pins may be subjected to bending forces due to out-of-tolerance couplers and traditional knuckle pins often fail when subjected to these bending force due to the stiffness of the knuckle pin. From the foregoing, it may be appreciated that a need has arisen for a knuckle coupler pin capable of surviving the bending forces found in railroad car coupling systems.

According to the present invention, a system and apparatus are provided to address the shortcomings of prior couplers. Among other things, the invention provides a coupler knuckle pin for use in a knuckle pin aperture of a railroad car coupler comprising a generally cylindrical body. The body has a longitudinal slot which extends between a first end of the body and a second end of the body. The coupler knuckle pin further comprises a first retaining element coupled to the first end of the body and operable to retain the body in the knuckle pin aperture.

According to another embodiment of the present invention, a railroad car coupling system comprises a coupler comprising a top portion and a bottom portion. The top portion has a first knuckle pin aperture disposed therethrough and the bottom portion has a second knuckle pin aperture disposed therethrough. The second knuckle pin aperture has a generally common longitudinal axis with the first knuckle pin aperture. The railroad car coupling system further comprises a knuckle pin comprising a generally cylindrical body. The body has a longitudinal slot extending between a first end and a second end of the body. The knuckle pin is disposable through the first and second knuckle pin apertures. The railroad car coupling system further comprises a knuckle rotatively coupled to the coupler by the knuckle pin. The knuckle has a third knuckle pin aperture disposed therethrough. The knuckle pin further extends through the third knuckle aperture. The railroad car coupling system further comprises a first retaining element coupled to the first end of the knuckle pin. The retaining element is engageable with the top portion to prevent downward movement of the knuckle pin through the first knuckle pin aperture.

According to yet another embodiment of the present invention, a railroad car comprises a coupler system coupled to the railroad car. The coupler system comprises a coupler, a knuckle pin and a knuckle. The coupler comprises a top portion and a bottom portion, the top portion having a first knuckle pin aperture disposed therethrough and the bottom portion having a second knuckle pin aperture disposed therethrough. The second knuckle pin aperture has a common longitudinal axis with the first knuckle pin aperture. The knuckle pin comprises a generally cylindrical body and a first retaining element. The body has a longitudinal slot extending between a first end and a second end of the body, and the knuckle pin is disposable through the first and second knuckle pin apertures. The first retaining element is coupled to the first end of the knuckle pin and is engageable with the top portion to prevent downward movement of the knuckle pin through the first knuckle pin aperture. The knuckle is rotatively coupled to the coupler by the knuckle pin and has a third knuckle pin aperture disposed therethrough. The first, second and third knuckle pin aperture have the common longitudinal axis and the knuckle pin extends through the third knuckle aperture.

BRIEF DESCRIPTION OF THE DRAWINGS

The present invention is best understood from the detailed description which follows, taken in conjunction with the accompanying drawings, in which:

FIG. 2 is a top view of a coupler in a locked position;

FIG. 3A is a side view of the coupler of FIG. 2;

FIG. 3B is a side view of the coupler of FIG. 2 in an unlocked position;

FIG. 4 is a top view of two couplers engaged with each other;

FIG. 5 is a perspective view of a knuckle pin;

DETAILED DESCRIPTION OF THE INVENTION

Coupling systems are often used to couple railroad cars to each other. During buff and draft movement of the railroad cars various forces are experienced by the coupling system. Under normal circumstances, a knuckle pin of the coupling system experiences some forces during buff and draft movement of the railroad cars. As coupling systems wear, and due to errors in the manufacture of the coupling systems, the distribution of force upon the coupling system changes. In particular, manufacturing errors and wear may increase the forces experienced by the knuckle pin of the coupling system. Specifically, bending forces are experienced by the knuckle pin because of the manufacturing errors and wear changing the dimensions of the coupling system. Traditional knuckle pins often fail under the increased bending forces. The present invention involves a cylindrical knuckle pin with a longitudinal slot and overcomes problems with traditional coupler systems. The slot allows the knuckle pin to crush in response to the increased bending forces so that the pin can withstand the increased bending forces without failing.

Figure 1:
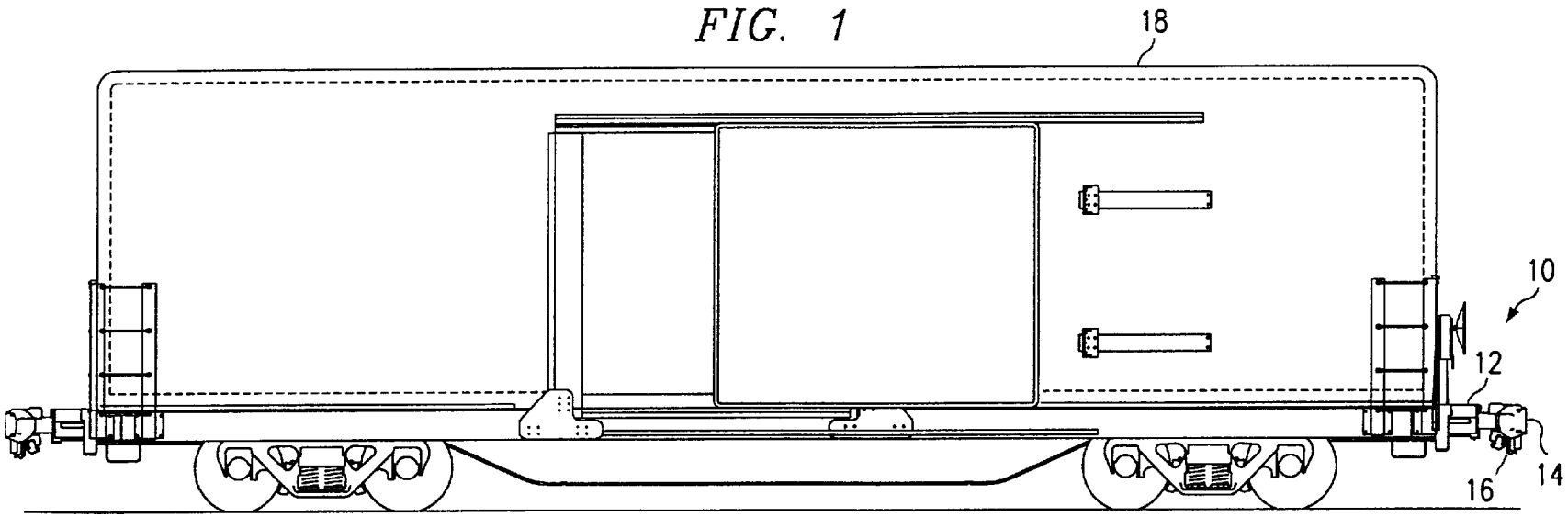
FIG. 1 is a side view of a railroad car with a coupler.

FIG. 1 is a side view of a railroad car with a railroad car coupling system. A railroad car coupling system 10 includes a coupler 12, a coupler knuckle 14, and a coupler pin 16. Coupler 12 is coupled to a railroad car 18 and provides a mounting location and support for coupler knuckle 14. Coupler knuckle 14 is rotatively coupled to coupler 12 by knuckle pin 16 as described in more detail in association with FIGS. 2, 3A and 3B. Railroad car 18 may be any of a variety of railroad cars well known in the art.

FIG. 2 is a top view of coupler system 10 in a locked position. FIGS. 3A and 3B respectively show a lock 30 in the locked and unlocked positions. FIGS. 2, 3A and 3B are described together for greater clarity. Lock 30 is coupled to coupler 12 and may be in a locked position or an unlocked position. Lock 30 operates to prevent pivotal movement of coupler knuckle 14 when lock 30 is in the locked position and allow pivotal movement of coupler knuckle 14 when lock 30 is in the unlocked position.

A locking mechanism 40 is coupled to coupler 12 and lock 30, and includes a handle 42 so that an operator (not shown) may move lock 30 from the locked position (FIG. 3A) to the unlocked position (FIG. 3B). In the unlocked position (FIG. 3B), lock 30 allows coupler knuckle 14 to disengage from another coupler knuckle (such as in FIG. 4). When lock 30 is in the unlocked position, coupler knuckle 14 is free to pivot about knuckle pin 16 such that a rear portion 32 of coupler knuckle 14 may pass through the area occupied by lock 30 when lock 30 is in the locked position. The movement of rear portion 32 allows coupler knuckle 14 to pivot clockwise around knuckle pin 16 to a position such that coupler knuckle 14 may disengage from another coupler knuckle.

When lock 30 is in the locked position (FIG. 3A), knuckle 14 is prevented from pivoting around knuckle pin 16 because rear portion 32 is engaged with lock 30. While rear portion 32 is engaged with lock 30, coupler knuckle 14 will not release another coupler knuckle which is engaged with coupler knuckle 14 because coupler knuckle 14 is prevented from pivoting by lock 30.

Coupler 12 includes a top portion 20 and a bottom portion 22. During use with railway cars, top portion 20 comprises the upper area of coupler 12 and bottom portion 22 comprises the underside of coupler 12. Top portion 20 includes a first aperture 24 and bottom portion 22 includes a second aperture 26. First aperture 24 vertically extends entirely through top portion 20 to allow insertion of knuckle pin 16 through upper portion 20. Preferably, second aperture 26 vertically extends entirely through bottom portion 22 to allow insertion of knuckle pin 16 therethrough. However, second aperture 26 may only extend partially into bottom portion 22 to allow pin 16 to partially penetrate bottom portion 22. First and second apertures 24 and 26 are both preferably generally oblong shaped apertures. In general, apertures 24 and 26 are at least slightly larger than the diameter of knuckle pin 16. First and second apertures 24 and 26 are horizontally aligned so that knuckle pin 16 may extend through both simultaneously. In other words, first and second apertures 24 and 26 share a common longitudinal axis.

Each oblong aperture has generally parallel and generally straight top and bottom edges, each with respective first and second ends. One end of the oblong aperture is defined by a first semi-circle which extends from the first end of the top edge and extends to the first end of the bottom edge. The other end of the oblong aperture is defined by a second semi-circle, similar to the first semi-circle, which extends from the second end of the top edge to the second end of the bottom edge. The top and bottom edges are approximately 0.125 inches long and are spaced approximately 1.625 inches apart from each other. The center point of the first semi-circle is located about at the center of an imaginary straight line extending from the first end of the top edge to the first end of the bottom edge. The center point of the second semi-circle is located about at the center of an imaginary straight line extending from the second end of the top edge to the second end of the bottom edge. The first and second semi-circles each have a radius of approximately 0.8125 inches as measured from the respective center points of the first and second semi-circles.

Knuckle 14 includes a third aperture 28 which extends vertically through the entire height of knuckle 14 to allow for the insertion of knuckle pin 16 therethrough. The third aperture 28 is from 0.625 inches to 1.75 inches in diameter and is preferably 1.65625 inches in diameter. In the disclosed embodiment, apertures 24, 26 and 28 may be horizontally aligned with a common longitudinal axis so that knuckle pin 16 may extend simultaneously through apertures 24, 26 and 28.

A retaining pin 44 may be removably disposed through a retaining pin aperture 46 extending generally horizontally through the lower end of knuckle pin 16. The retaining pin 44 prevents longitudinal movement of knuckle pin 16 when the knuckle pin 16 is disposed in first, second and third apertures 24, 26 and 28. The retaining pin 44 may comprise a cotter pin or other suitable pin or retaining element for preventing knuckle pin 16 from exiting first, second and third apertures 24, 26 and 28. For example, retaining pin 40 may be used to prevent knuckle pin 16 from vibrating out of first, second and third apertures 24, 26 and 28 during use of coupling system 10.

FIG. 4 is a top view of two coupler knuckles engaged with each other. A first coupling system 10A includes a first coupler 12A, a first knuckle 14A, a first knuckle pin 16A and a first lock 30A. A second coupling system 10B includes a second coupler 12B, a second knuckle 14B, a second knuckle pin 16B and a second lock 30B.

Various forces are applied to first and second coupling systems 10A and 10B during buff and draft movement of their associated railcars. Coupling systems 10A and 10B are designed to distribute the buff and draft forces over couplers 12A and 12B, knuckles 14A and 14B, and locks 30A and 30B. By designing and manufacturing the various components to have specific measurements within specific tolerances, only some force resulting from the buff and draft movement of the associated railcars are applied to the knuckle pins 16A and 16B. For example, knuckle pins often experience forces of less than 4000 pounds of pressure under normal operation of the coupling systems 10A and 10B.

Traditional knuckle pins were designed under the assumption that some force would be applied to the knuckle pin under normal operation. However, due to wear over time, manufacturing errors, and other factors, couplers 12A and 12B, knuckles 14A and 14B and locks 30A and 30B may fall out of tolerance. Stated another way, over time and due to manufacturing errors, the actual measurements of couplers 12A and 12B, knuckles 14A and 14B and locks 30A and 30B change to such an extent that the actual measurements will exceed the maximum and minimum tolerances for the design measurements. As the various components fall out of tolerance, the distribution of forces on coupling systems 10A and 10B may change. As the various components fall out of tolerance, increasing buff and draft forces, in the form of bending forces, are applied to knuckle pins 16A and 16B. The bending forces experienced by knuckle pins are sufficient to cause failure of traditional solid knuckle pins. However, the cylindrical, slotted knuckle pins 16A and 16B of the present invention provide for increased survival against these bending forces.

Traditional solid pins include a minimal ability to bend in response to the bending forces caused by out-of-tolerance coupling systems 10A and 10B. Thus, solid pins attempt to rigidly resist all forces, which may be up to approximately 100,000 pounds of pressure, before failing. Due to the rigidity of traditional solid knuckle pins, the components of coupling systems such as 10A and 10B can not align to properly distribute forces within the coupling system. By contrast, cylindrical, slotted knuckle pins 16A and 16B include the ability to compress in response to forces up to 12,000 pounds. Knuckle pins 16A and 16B may also be designed to compress at pressures greater than 12,000 pounds if necessary. By compressing, knuckle pins 16A and 16B respectively allow the various components of coupling systems 10A and 10B to align which distributes the forces more correctly over coupling systems 10A and 10B. By allowing alignment of the various components of coupling systems 10A and 10B, knuckle pins 16A and 16B are subjected to less overall force and, thus, survive longer than traditional knuckle pins.

In addition, knuckle pins may also have problems during release of engaged knuckles 14A and 14B. When locks 30A and 30B are respectively in the unlocked position and knuckles 14A and 14B are allowed to disengage, opening forces of about 20,000 pounds may be experienced by the knuckles 14A and 14B as the knuckles 14A and 14B disengage. Some knuckle pins, for example, non-metallic knuckle pins, have insufficient rigidity to withstand these opening forces and experience significant bending in response thereto. The significant bending of some traditional knuckle pins cause knuckles 14A and 14B to shift to such an extent that locks 30A and 30B respectively fall behind knuckles 14A and 14B. Removing locks 30A and 30B from behind knuckles 14A and 14B requires significant time. Knuckle pins 16A and 16B include sufficient rigidity that knuckle pins 16A and 16B do not deform to such an extent that locks 30A and 30B fall behind knuckles 14A and 14B, respectively, during disengagement of knuckles 14A and 14B.

Figure 5A:
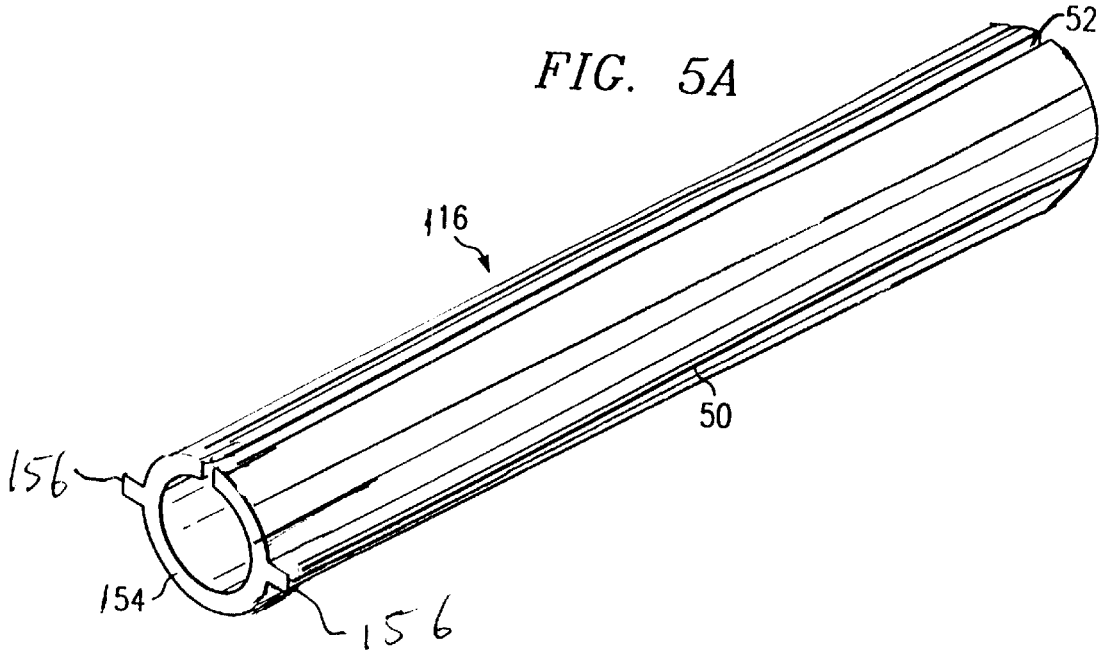
FIG. 5A is a perspective view of an alternate embodiment of a knuckle pin.
Figure 5B:
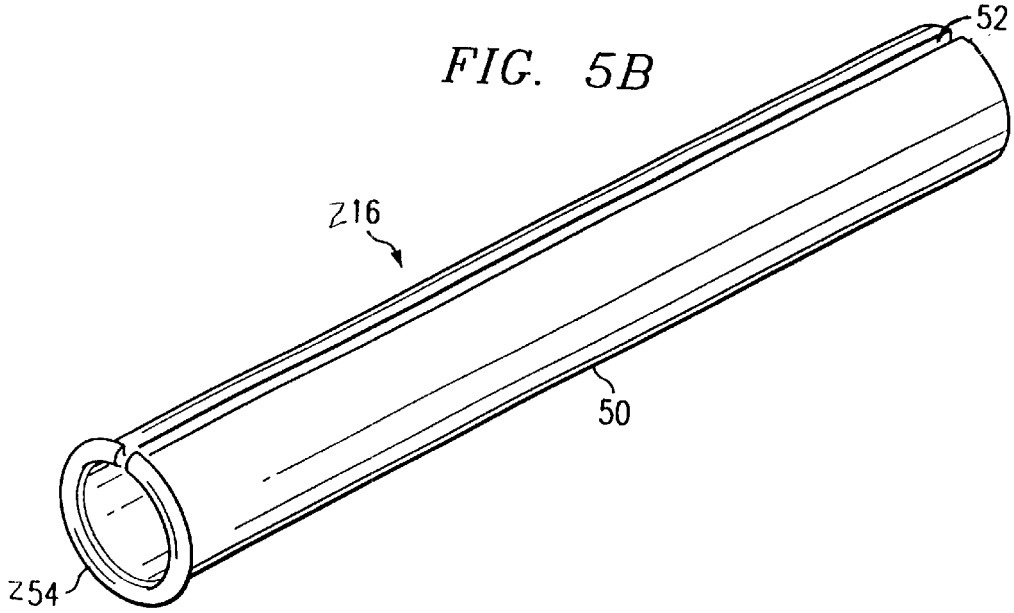
FIG. 5B is a perspective view of another alternate embodiment of a knuckle pin.

FIG. 5 is a perspective view of knuckle pin 16. FIG. 5A is a perspective view of a knuckle pin 116 illustrating an alternate embodiment. FIG. 5B is a perspective view of a knuckle pin 216 illustrating another alternate embodiment. FIGS. 5, 5A and 5B are discussed together for greater clarity.

Knuckle pin 16 comprises a body 50 and a slot 52. Body 50 has a generally cylindrical shape. The body preferably has a wall thickness of about 0.125 inches to 0.75 inches and is preferably between 0.125 and 0.5 inches, inclusive. Body 50 is preferably between about 12 to 20 inches long, inclusive, and is preferably between about 13 to 14 inches long, inclusive. In the disclosed embodiment, body 50 is 13.375 inches long. Body 50 may be between 1.25 and 2 inches, inclusive, in outer diameter and preferably has an outer diameter of 1.625 inches. Body 50 has an inner diameter equal to the outer diameter minus two times the wall thickness. Body 50 may be formed from the materials American Iron and Steel Institute 4130, 4140 and 6150. Body 50 may also be formed from other suitable materials, for example, as discussed below with respect to slot 52. Preferably, knuckle pin 16 weighs approximately six pounds less than the traditional solid knuckle pins currently in use in the industry. In general, knuckle pin 16 preferably weighs approximately between 2 and 10 pounds, inclusive, and, in the disclosed embodiment, is about 6 pounds.

Slot 52 extends along the entire length of body 50 and is preferably parallel with a longitudinal axis of body 50. Slot 52 is between 0.03125 inches and 0.75 inches in width and is preferably between 0.25 inches and 0.5 inches. More preferably, slot 52 is between 0.25 and 0.375 inches, inclusive, in width. The size of slot 52 may be determined more generally as a function of the magnitude of the bending forces expected to be experienced by knuckle pin 16 and the deformation characteristics of the metal used to form knuckle pin 16. In particular, knuckle pin 16 is preferably formed from a material capable of deforming sufficiently to allow the complete closure of slot 52 (under maximum anticipated bending forces) while maintaining the capability of the material to return generally to the original shape of knuckle pin 16 and generally the original size of slot 52 after the anticipated bending forces have been removed. However, under certain conditions, knuckle pin 16 may be permanently deformed and thus may not entirely return to the original shape of knuckle pin 16 and size of slot 52. Thus, the use of appropriate materials to form knuckle pin 16 may allow for exceeding the listed ranges for the size of slot 52. In the disclosed embodiment, slot 52 may be oriented in any direction when knuckle pin 16 is disposed within first, second and third apertures 24, 26 and 28.

Slot 52 allows knuckle pin 16 to survive the bending forces exerted upon it when the knuckle pin is used with coupling system 10. Due to the stresses placed on coupling system 10 from use and manufacturing errors, coupling system 10 will often begin to move out of the originally specified tolerances. As coupler components move farther and farther out of tolerance, greater and greater bending forces may be applied to the knuckle pin 16 during buff and draft movement of the associated railcar. Slot 52 allows knuckle pin 16 to compress in response to the bending forces instead of failing. Slot 52 allows body 50 to compress with the bending forces, in contrast to traditional knuckle pins which attempt to resist the bending forces because of their solid and unslotted design. Stated another way, body 50 is flexible between a state in which slot 52 is open and a second state in which slot 52 is closed. The first state corresponds to a rest state in which no bending forces are applied to body 50. The second state corresponds to a state in which a predetermined maximum anticipated bending force is applied to body 50. In response to increasing bending forces applied to body 50, body 50 increasingly flexes away from the first state and toward the second state. In response to the removal of bending forces, body 50 flexes away from the second state back toward the first state.

As shown in FIG. 5, knuckle pin 16 has a head 54.

Head 54 is an annular flange extending at least partially around the circumference of one end of body 50 and perpendicular to the long axis of body 50. Slot 52 extends through head 54. According to one aspect of this embodiment, head 54 may comprise one or more arcuate flange portions extending partially about a circumference of one end of body 50. Head 54 has a diameter of about 1.5 inches to 3 inches, inclusive, and preferably is about 2.0625 inches in diameter. Head 54 has a thickness of about 0.125 inches to 0.5 inches, inclusive. Head 54 is engageable with top portion 20 of coupler 12 (FIGS. 3A and 3B).

In another embodiment, slot 54 is oriented in a particular direction when knuckle pin 16 is disposed with the first, second and third apertures 24, 26 and 28. In this embodiment, head 54 will have a non-uniform shape. Head 54 is engageable with a contour (not-shown) of coupler 12 surrounding first aperture 24 such that slot 54 is oriented in a predetermined direction and knuckle pin 16 is prevented from substantial rotational movement within apertures 24, 26 and 28. The contour comprises a raised rib running generally around first aperture 24. Head 54 is engageable with the contour because head 54 will be shaped such that portions of an outer edge of head 54 engages the rib at one or more locations. The contour may have a non-uniform shape and vary in distance from first aperture 24 from 0.5 inches to 1 inch. Retaining pin 44 may also be used to prevent rotational movement of knuckle pin 16 in apertures 24, 26 and 28. In this embodiment, retaining pin 44 includes a wedge shaped end engageable with bottom portion 22 to resist rotational movement of knuckle pin 16.

In an alternate embodiment, as shown in FIG. 5A, a head 154 may comprise a pair of tabs extending radially outward from body 50 and being displaced approximately 90° from slot 52 and 180° from each other. Even though this configuration of tabs is preferably for this alternate embodiment, other configurations of one or more tabs may be used. Thus, according to one aspect of this embodiment, head 154 comprises one or more tabs 156 spaced from slot 52 and extending normal to and outward from a longitudinal axis of body 50. Tabs 156 are between 0.125 and 0.75 inches in width and extend outwardly up to 3 inches from the inner wall of body 50. Preferably, tabs 156 extend between 1 inch and 3 inches from a center axis of body 50.

In yet another alternate embodiment, as shown in FIG. 5B, head 254 may comprise a rounded head formed integral to knuckle pins 216. According to an aspect of this embodiment, head 254 may comprise one or more rounded, arcuate flange portions each extending partially about a circumference of one end of body 50.

In general, head 54 may comprise any suitable retaining element for retaining knuckle pin 16 in apertures 24, 26 and 28 against the force of gravity. Preferably, the head extends outwardly away from a longitudinal axis of body 50 to a point at least slightly outside of the diameter of aperture 24 and is engageable with coupler 12, and, more specifically, with upper portion 20 so that body 50 remains disposed through apertures 24, 26 and 28, and does not drop through apertures 24, 26 and 28 during use.

The present invention provides a number of technical advantages. One such technical advantage is the ability of the knuckle pin to survive the bending forces experienced by the knuckle pin during buff and draft movement of railroad cars with out-of-tolerance couplers. A further advantage is that a cylindrical knuckle pin provides a weight savings of approximately twelve pounds per car (by saving six pounds per coupler) over traditional solid knuckle pins. Another advantage is that the knuckle pin according to the present invention may be manufactured for approximately the same cost as traditional solid knuckle pins. Yet another advantage is that the knuckle pin according to the present invention is the capability to withstand opening forces during disengagement of knuckles while preventing the locks from falling behind the knuckles.

It should also be recognized that direct connections disclosed herein could be altered, such that two disclosed components or elements would be coupled to one another through an intermediate device or devices without being directly connected, while still realizing the present invention. Other changes, substitutions and alterations are also possible without departing from the spirit and scope of the present invention, as defined by the following claims.

What is claimed is:

1. A railroad car coupler system comprising:

a coupler comprising a first aperture;

a knuckle comprising a second aperture; and a knuckle pin disposed at least partially through both the first and second apertures such that the knuckle is rotatively coupled to the coupler;

wherein the knuckle pin comprises:

a generally tubular body having a wall, the wall having a longitudinal slot extending completely therethrough; and a first retaining element coupled to a first end of the body and operable to retain a portion of the body in the first aperture.

2. The coupler system of claim 1, wherein the first retaining element comprises a flange coupled to the first end, the flange extending generally perpendicular to the first end, and wherein the slot extends through the flange.

3. The coupler system of claim 2, wherein the flange is generally planar and extends at least partially about the first end of the knuckle pin and wherein the flange is between 1.5 inches and 3 inches in diameter.

4. The coupler system of claim 3, wherein the slot comprises a first edge and a second edge, the first and second edges separated by a gap, and wherein the flange further extends about the first end of the knuckle pin from the first edge of the slot to the second edge of the slot.

5. The coupler system of claim 1, wherein the first retaining element comprises an annular flange head having a rounded cross-section.

6. The coupler system of claim 1, wherein the first retaining element comprises at least one tab coupled to the first end and extending generally perpendicular thereto and wherein each tab is between 0.125 and 0.75 inches in width and extend outwardly up to 3 inches from an inner surface of the wall of the body.

7. The coupler system of claim 6, wherein the at least one tab comprises a pair of tabs and wherein the tabs extend approximately 1 inch to 3 inches from a center axis of the body.

8. The coupler system of claim 7, wherein the pair of tabs comprise a first tab and a second tab, the first tab being disposed along the first end at about 90 degrees from the slot, the second tab being disposed along the first end at about 90 degrees from the slot and about 180 degrees from the first tab.

9. The coupler system of claim 1 further comprising a second retaining element coupled to a second end of the knuckle pin and operable to retain the knuckle pin in the knuckle pin aperture of the coupler.

10. The coupler system of claim 9, wherein the second retaining element comprises a retaining pin coupled generally perpendicular to the knuckle pin.

11. The coupler system of claim 10, wherein the retaining pin is disposed through the second end of the knuckle pin in a direction perpendicular to the longitudinal axis of the knuckle pin.

12. The coupler system of claim 1, wherein the knuckle pin is approximately between twelve and 20 inches long.

13. The coupler system of claim 1, wherein the knuckle pin is approximately thirteen inches long.

14. The coupler system of claim 1, wherein the wall of the knuckle pin body is approximately between 0.125 inches and 0.75 inches in thickness.

15. The coupler system of claim 1, wherein the knuckle pin is approximately between 1.25 inches and 2 inches in outer diameter.

16. The coupler system of claim 1, wherein a width of the slot is approximately between 0.03125 inches and 0.75 inches.

17. The coupler system of claim 16, wherein a width of the slot is between 0.25 and 0.5 inches, inclusive.

18. The coupler system of claim 1, wherein the body is flexible between a state in which the slot is open and a second state in which the slot is closed.

19. The coupler system of claim 18, wherein the first state corresponds to a rest state in which no bending forces are applied to the body.

20. The coupler system of claim 18, wherein the second state corresponds to a state in which a predetermined maximum anticipated bending force is applied to the body.

21. The coupler system of claim 1, wherein the longitudinal slot extends from a first end of the body toward a second end of the body.

22. The coupler system of claim 21, wherein the longitudinal slot extends completely from a first end of the body to a second end of the body.

23. A railroad car coupling system comprising:

a coupler comprising a top portion and a bottom portion, the top portion having a first knuckle pin aperture disposed therethrough and the bottom portion having a second knuckle pin aperture disposed therethrough, the second knuckle pin aperture having a generally common longitudinal axis with the first knuckle pin aperture;

a knuckle pin comprising a generally tubular body having a wall, the wall having a longitudinal slot extending completely therethrough, the knuckle pin being disposable through the first and second knuckle pin apertures;

a knuckle rotatively coupled to the coupler by the knuckle pin and having a third knuckle pin aperture disposed therethrough, wherein the knuckle pin extends through the third knuckle aperture; and a first retaining element coupled to a first end of the knuckle pin and engageable with the top portion to prevent downward movement of the knuckle pin through the first knuckle pin aperture.

24. The railroad car coupling system of claim 23 further including a second retaining pin coupled to a second end of the knuckle pin.

25. The railroad car coupling system of claim 24, wherein the second end has a retaining pin aperture disposed therethrough and wherein the second retaining pin is a cotter pin disposed through the knuckle pin aperture of the second end of the knuckle pin.

26. The railroad car coupling system of claim 23, wherein the first retaining element comprises a flange coupled to the first end, the flange extending generally perpendicular to the first end, and wherein the slot extends through the flange.

27. The railroad car coupling system of claim 26, wherein the flange is generally planar and extends at least partially about the first end of the knuckle pin, and wherein the flange is between 1.5 inches and 3 inches in diameter.

28. The railroad car coupling system of claim 23, wherein the first retaining element is at least one tab coupled to the first end and extending generally perpendicular thereto.

29. The railroad car coupling system of claim 23, wherein the knuckle pin is approximately between twelve and 20 inches long.

30. The railroad car coupling system of claim 23, wherein the wall of the knuckle pin body is approximately between 0.125 and 0.75 inches in thickness.

31. The railroad car coupling system of claim 23, wherein the knuckle pin is approximately between 1.25 inches and 2 inches in outer diameter.

32. The railroad car coupling system of claim 23, wherein the slot is approximately between 0.03125 inches and 0.75 inches wide.

33. The railroad car coupling system of claim 32, wherein the slot is between 0.25 and 0.5 inches, inclusive, in width.

34. The coupler knuckle pin of claim 23, wherein the longitudinal slot extends from a first end of the body toward a second end of the body.

35. The coupler knuckle pin of claim 34, wherein the longitudinal slot extends completely from a first end of the body to a second end of the body.

36. A railroad car, comprising:

a coupler system coupled to the railroad car and comprising:

a coupler, the coupler comprising a top portion and a bottom portion, the top portion having a first knuckle pin aperture disposed therethrough and the bottom portion having a second knuckle pin aperture disposed therethrough, the second knuckle pin aperture having a generally common longitudinal axis with the first knuckle pin aperture;

a knuckle pin comprising:

a generally tubular body having a wall, the wall having a longitudinal slot extending completely therethrough, the knuckle pin being disposable through the first and second knuckle pin apertures; and a first retaining element coupled to a first end of the knuckle pin and engageable with the top portion to prevent downward movement of the knuckle pin through the first knuckle pin aperture; and a knuckle rotatively coupled to the coupler by the knuckle pin and having a third knuckle pin aperture disposed therethrough, wherein the first, second and third knuckle pin aperture have the common longitudinal axis and wherein the knuckle pin extends through the third knuckle aperture.

37. The railroad car of claim 36, wherein the coupler system further includes a second retaining pin coupled to a second end of the knuckle pin.

38. The railroad car of claim 37, wherein the second end has a retaining pin aperture disposed therethrough and wherein the second retaining pin is a cotter pin disposed through the knuckle pin aperture of the second end of the knuckle pin.

39. The railroad car of claim 36, wherein the first retaining element comprises a flange coupled to the first end, the flange extending generally perpendicular to the first end, and wherein the slot extends through the flange.

40. The railroad car of claim 39, wherein the flange is generally planar and extends at least partially about the first end of the knuckle pin, and wherein the flange is between 1.5 inches and 3 inches in diameter.

41. The railroad car of claim 36, wherein the first retaining element is at least one tab coupled to the first end and extending generally perpendicular thereto.

42. The railroad car of claim 36, wherein the knuckle pin is approximately between twelve and 20 inches long.

43. The railroad car of claim 36, wherein the wall of the knuckle pin body is approximately between 0.125 inches and 0.75 inches in thickness.

44. The railroad car of claim 36, wherein the knuckle pin is approximately between 1.25 inches and 2 inches in outer diameter.

45. The railroad car of claim 36, wherein the slot is approximately 0.03125 inches and 0.75 inches wide.

46. The railroad car of claim 45, wherein the slot is between 0.25 and 0.5 inches, inclusive, in width.

47. The coupler knuckle pin of claim 36, wherein the longitudinal slot extends from a first end of the body toward a second end of the body.

48. The coupler knuckle pin of claim 47, wherein the longitudinal slot extends completely from a first end of the body to a second end of the body.

* * * * *